US007717825B2

(12) United States Patent
Van Der Hoeven

(10) Patent No.: US 7,717,825 B2
(45) Date of Patent: May 18, 2010

(54) ABDOMINAL EXERCISER WITH ELECTRONIC COACHING DEVICE

(76) Inventor: Martin A. Van Der Hoeven, 4646 Rancho Reposo, Del Mar, CA (US) 92014

( * ) Notice: Subject to any disclaimer, the term of this patent is extended or adjusted under 35 U.S.C. 154(b) by 1756 days.

(21) Appl. No.: 10/725,997

(22) Filed: Dec. 3, 2003

(65) Prior Publication Data

US 2005/0124474 A1 Jun. 9, 2005

(51) Int. Cl.
*A63B 71/00* (2006.01)

(52) U.S. Cl. ..... 482/8; 482/1; 482/9

(58) Field of Classification Search ..... 482/1–9, 482/900–902; 434/247, 254
See application file for complete search history.

(56) References Cited

U.S. PATENT DOCUMENTS 5,598,849 A 2/1997 Browne
5,795,275 A 8/1998 Van Der Hoeven et al.
5,857,939 A 1/1999 Kaufman
6,251,048 B1 6/2001 Kaufman
6,312,363 B1 11/2001 Watterson et al.
6,458,060 B1 10/2002 Watterson et al.
6,582,342 B2 6/2003 Kaufman
6,626,799 B2 9/2003 Watterson et al.
6,634,992 B1 * 10/2003 Ogawa ..... 482/8
6,672,991 B2 * 1/2004 O'Malley ..... 482/8
6,716,139 B1 * 4/2004 Hosseinzadeh-Dolkhani et al. ..... 482/1
6,837,827 B1 * 1/2005 Lee et al. ..... 482/8
6,852,068 B2 * 2/2005 Ogawa ..... 482/8
6,921,351 B1 * 7/2005 Hickman et al. ..... 482/8
6,955,542 B2 * 10/2005 Roncalez et al. ..... 434/254

* cited by examiner

*Primary Examiner*—Glenn Richman
(74) *Attorney, Agent, or Firm*—Morrison & Foerster LLP

(57) ABSTRACT

An abdominal exercise apparatus includes a device that instructs and encourages a user. The apparatus comprises a slide member positioned in a channel of a body. The slide member has a user engagement end extending from the channel for engaging a targeted muscle area of the user. A resilient member biases the body and slide in one direction. Handles are attached to the body at opposing locations, and extend away from the body. The instructional device instructs users how to perform multiple phase abdominal exercises and provides motivation. The instructional device comprises a microprocessor, a sound creating mechanism, a visual display, and a user interface. The sound creating mechanism produces prerecorded instructions or motivation. The visual display includes lights to visually instruct the user of the proper amount of time for each phase of an exercise. The user interface allows for a user to select various exercise routines and levels.

18 Claims, 7 Drawing Sheets

ABDOMINAL EXERCISER WITH ELECTRONIC COACHING DEVICE

FIELD OF THE INVENTION

The present invention relates generally to a home exercise device. In particular, the present invention relates to a device for providing personal exercise instruction and coaching to a user of abdominal isometric exercise methods and equipment.

BACKGROUND OF THE INVENTION

Physical exercise generally improves health and physical conditioning. The benefits of regular physical activity can be obtained through several types of exercise. Each type of exercise includes at least one of the four muscular phases. These muscular phases are isokinetic, isometric, concentric, and eccentric. The isokinetic muscular phase is achieved through quick repetitive motion, while the isometric muscular phase is achieved through the tightening and holding of these tightened muscles. The concentric muscular phase is achieved through the slow contraction of muscles, while the eccentric muscular phase is achieved through the slow relaxation of the muscles under a load.

Exercise that use the isometric muscular phase (hereinafter referred to as "isometric exercise") are effective for developing strength in a specific muscle or group of muscles. Isometric exercises may be used for rehabilitation because of the ability to isolate the exact area of muscle weakness. Additionally, this type of exercise can provide a fairly quick and convenient method for overloading and strengthening muscles with slight chance of injury and without the need for special equipment.

The efficient development of the abdominal muscles of the human body is particularly difficult. Because the abdominal muscles are not attached to any joint, traditional joint movement exercises are ineffective. Exercises such as sit-ups or weight-loaded variations on sit-ups may indirectly involve the abdominal muscles, but are inefficient because much exercise energy is dissipated in the joints and muscles attached to the joints, such as hip flexors. The use of isometric exercises on the abdominal region has the result of isolating the abdominal muscles, thereby allowing the proper muscles to be overloaded and strengthened.

However, for any isometric exercise to yield the proper results, it must be performed properly. The exercise must focus on the proper muscle and the proper muscle must be contracted, held contracted and relaxed for the proper time intervals. If the exercise is performed on the wrong muscle group, the targeted group will receive no overloading, and thus will not strengthen. If the exercise is performed on the correct muscle group, but for incorrect time intervals, the targeted muscle group will not undergo the proper overloading required to strengthen.

The majority of people who exercise are unaware of the proper methods of isometric exercise. During the exertion of exercising, even those who are aware of the proper method and timing often fail to follow it. Thus, there is a need for instruction with regard to the performance of isometric exercises, particularly there is a need for instruction as to how long to contract the muscles, hold the muscles in a contracted state, and relax the muscles.

Additionally, during any exercise routine, the user often has a need for motivation and encouragement. As with any exercise, the exertions of each movement gradually become more and more difficult, typically causing the user to need motivation or encouragement to finish. It is generally accepted that the majority of muscle overloading and growth happens in the last few repetitions of an exercise, and these are typically the repetitions that, without motivation or encouragement, the user will forego. Since the movement and actions are the same for each exercise repetition, the user may also become bored, and may therefore need motivation or encouragement to finish the proper number of repetitions while performing them correctly.

This need for motivation or encouragement is often solved by users joining a fitness club or gymnasium. Fitness clubs and gymnasiums often offer what are known as "personal trainers," who offer exercise instruction as well as motivation and encouragement. However, there are several drawbacks to personal trainers, as well as fitness clubs and gymnasiums. First, joining a fitness club or gymnasium generally costs a significant amount of money. Obtaining the instruction and motivation of a personal trainer can often cost the user even more. Second, the time required to go to a fitness club or gymnasium and exercise often exceeds the time available to people to exercise. Third, having to travel to a different area in order to exercise can be quite inconvenient, depending on the location of the fitness club or gymnasium.

Some of these drawbacks are solved by using home exercise equipment. Such home equipment may be relatively inexpensive, and the user can exercise when he or she has time and when it is convenient. However, the majority of home exercise products do not offer the user the instruction or motivation that can be found at a fitness club or gymnasium. Such home exercise equipment may include instructional videos or digital video discs, but such aids are inconvenient in that they are separate from the exercise device. This separation often leads to the user foregoing use of the instructional video or digital video disc.

In view of the foregoing, there is a need for a home abdominal isometric exercise device that has a component which provides active instruction and motivation to the user. There is also a need for such an exercise instruction component that visually and/or audibly guides the user through different multiple muscular phases of an exercise.

SUMMARY OF THE INVENTION

Responsive to the forgoing challenges, Applicant has developed an innovative device and method for electronically coaching a user of an exercise apparatus that a user operates to perform an exercise activity having multiple muscular phases. The method generally comprises: determining that the exercise activity should be performed according to a first muscular phase; providing a user perceptible output to prompt the user to operate the exercise device according to the first muscular phase; determining that the exercise activity should be performed according to a second muscular phase that differs from the first muscular phase; and providing a second user perceptible output different from the first user perceptible output, to prompt the user to operate the exercise device according to the second muscular phase. In alternative embodiments, the method may further comprise determining that the exercise activity should be performed according to a third muscular phase that differs from the first and second muscular phases, and providing a third user perceptible output that different from the first and second perceptible outputs, to prompt the user to operate the exercise device according to the third muscular phase.

The instructional device, which can be referred to as an "electronic coach," may be programmed to instruct users as to the optimal way to perform multiple muscular phase abdominal exercises, as well as provide motivation during the exercise. The electronic coach includes a visual display and an audio output. The audio output may be used to produce prerecorded words or sentences in order to instruct and motivate the user. The visual display provides a user interface that guides the user through the exercise. In one embodiment, the user interface includes a plurality of lights, in order to visually instruct the user of the proper amount of time for each portion of an exercise. The user interface may also allow a user to select various exercise routines and levels, as well as allow the exercise routine to be paused or cancelled.

It is to be understood that both the foregoing general description and the following detailed description are exemplary and explanatory only, and are not restrictive of the invention as claimed.

BRIEF DESCRIPTION OF THE DRAWINGS

In order to assist in the understanding of the invention, reference will now be made to the appended drawings, in which like reference characters refer to like elements. The drawings are exemplary only, and should not be construed as limiting the invention.

DETAILED DESCRIPTION OF THE EMBODIMENTS OF THE INVENTION

Reference will now be made in detail to a first embodiment of the present invention, an example of which is illustrated in the accompanying drawings.

Figure 1A:
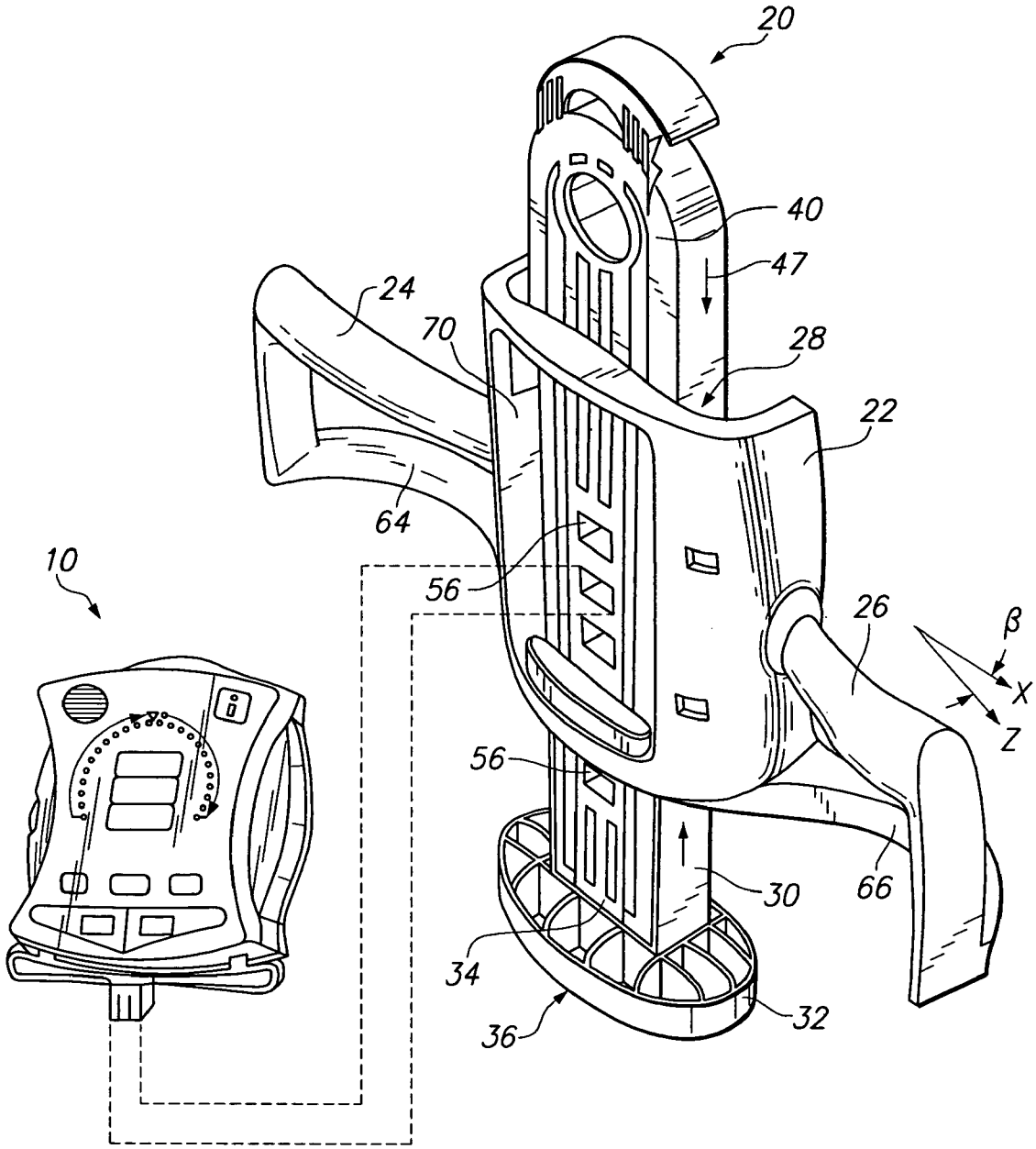
FIG. 1A is a perspective view of an exercise device including an electronic coach device in accordance with the present invention.

FIG. 1A depicts an exercise apparatus 20 that electronic coach 10 may be used with in accordance one embodiment of the present invention. The exercise apparatus comprises a generally rectangular body 22 forming a yoke that connects a pair of handles 24 and 26. The handles are positioned on opposing locations of the yoke and extend away from the yoke at angles with the X axis and Y axis. A slide member 30 is slidably held in a channel 28 that extends through the center of the yoke in a direction perpendicular to the X axis. The slide reciprocates back and forth in a longitudinal direction in the channel. A base 32 is detachably connected at a user engagement end 34 of the slide. The user engagement end extends out of the channel to engage a targeted muscle area. The base has a user engagement surface 36, which is sized to provide a large contact area with a user's body to increase stability and reduce the pressure in the contact area. The engagement surface may also be provided with a foam pad to cushion the contact area.

Figure 1B:
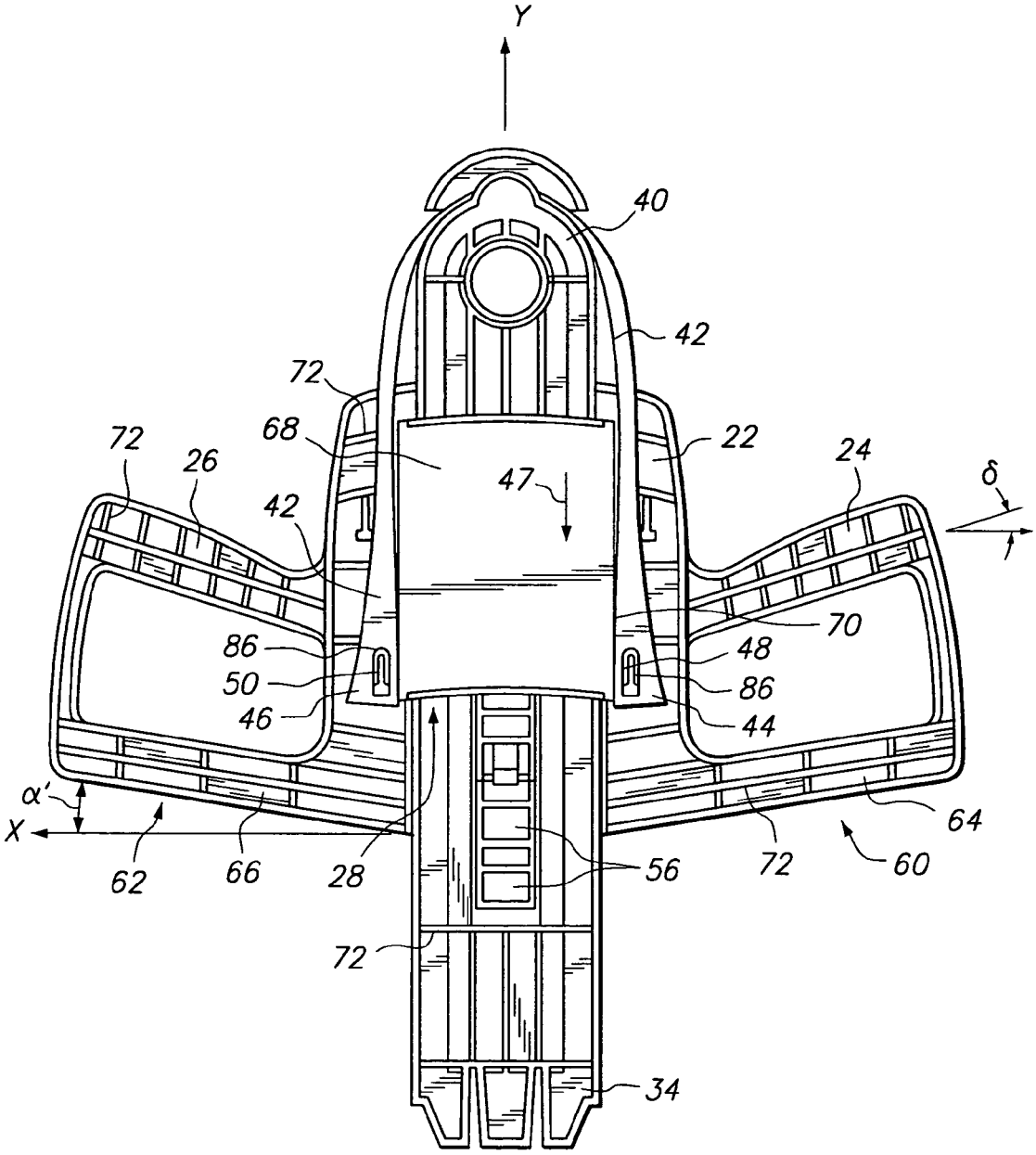
FIG. 1B is a cross-sectional view of the exercise device of FIG. 1A.

FIG. 1B is a cross sectional view of the exercise apparatus. As indicated, the opposite end of slide 30 is a resilient member engagement end 40, that engages a median portion of a resilient member, such as an elastic cord 42. The extremities 44 and 46 of elastic cord 42 each have an aperture 86 attached to one of a pair of anchoring posts 48 and 50 that extend from the undersurface of the yoke on opposite sides of channel 28 and slide 30. The middle of elastic cord 42 wraps around the resilient member engagement end 40. This results in the elastic cord 42 engaging both the body and slide to bias the slide toward the user. As the slide progresses into the channel away from the user, it stretches the elastic cord 42 which resiliently opposes the movement.

The yoke and handle assembly 22 is formed as an integral piece of plastic including a bottom plate 68 and side walls 70, that form the channel 28 to engage and guide the movement of the slide. The body comprises two opposing sides and the channel is located between the sides. Each handle is attached to only one side and is opposite the other handle. Reinforcing ribs 72 are utilized throughout the body and the handles to ensure adequate strength and rigidity. Each of the two handles 24 and 26 mark the end of wrist receiving areas 60 and 62, which are bridged by arcuate wrist support strips 64 and 66. These wrist support strips support the wrists of the user, providing comfort and safety while additionally providing strength and stability to the apparatus.

The handles extend from the X axis at equal angles, with the magnitude and direction of the angles selected such that the user's arms are placed in a natural position while exercising to increase stability. With the handles angled, the user's elbows rest comfortably in a natural position besides the torso. To add further stability, the handles extend at least as high, and preferably above, the top of the body of the device.

Figure 3:
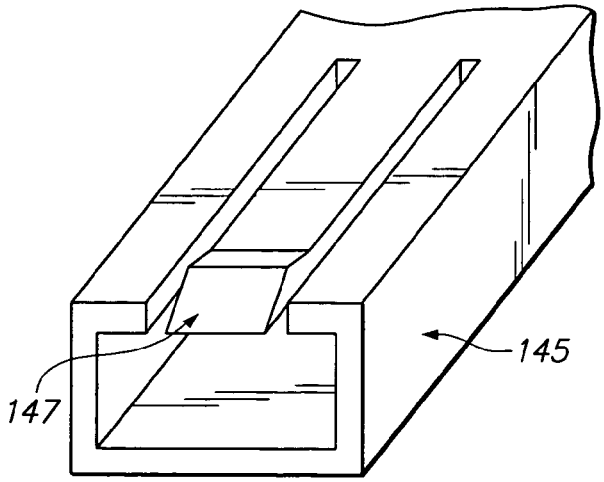
FIG. 3 is a detail view of a locking device to attach the electronic coach device to an exercise device according to an embodiment of the present invention.
Figure 4:
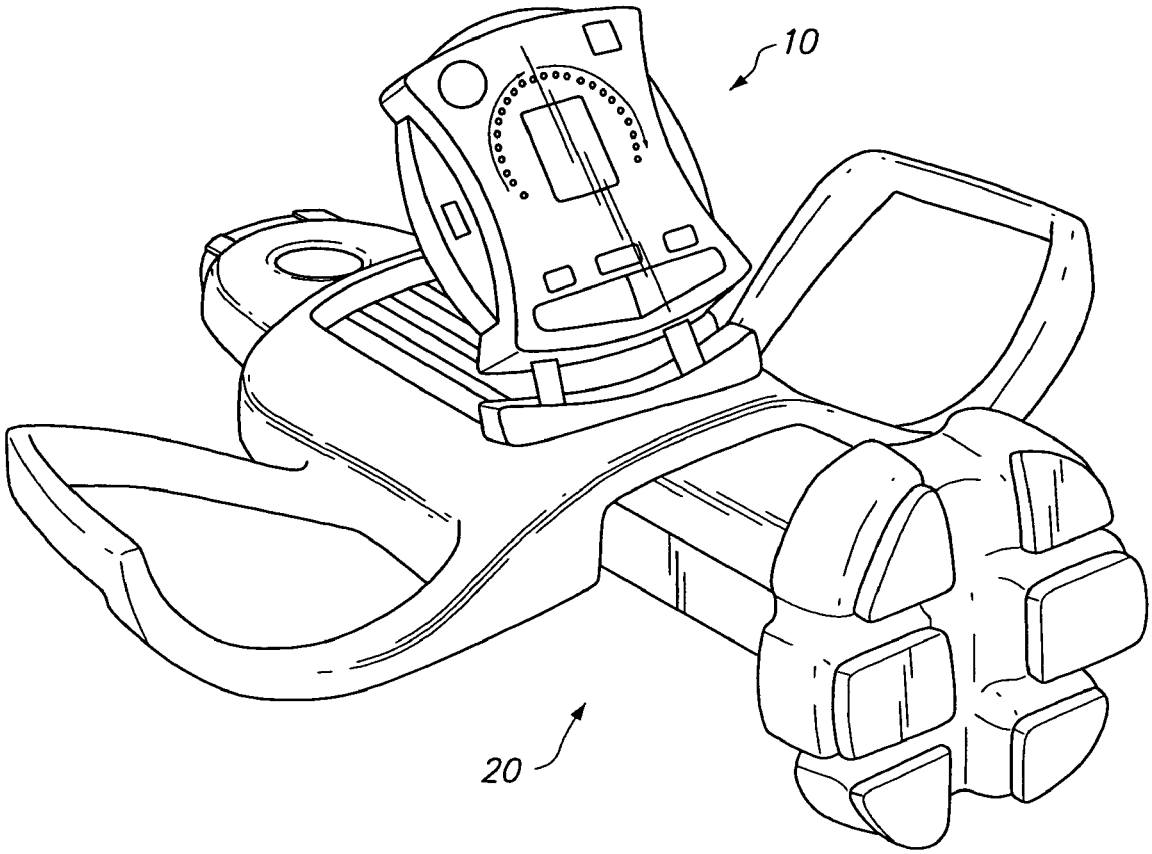
FIG. 4 is a perspective view of an embodiment of an exercise device with an electronic coach device mounted thereon in accordance with the present invention.

The slide member includes at least one rectangular cavity 56 centrally positioned in a lateral direction. The rectangular cavity 56 may be disposed so as to receive a rectangular extrusion 145 on the electronic coach 10. As seen in FIG. 3, the rectangular extrusion 145 includes a biased locking device 147, that prevents the electronic coach 10 from sliding out of the exercise device 20. When the extrusion 145 is inserted into the rectangular cavity 56 on the slide, the user will be able to clearly see and hear the electronic coach throughout the exercise routine. This can be seen in FIG. 4, which depicts an electronic coach 10 mounted on an exercise device 20 according to one embodiment of the present invention.

The exercise apparatus 20 may be used to develop abdominal muscles. A user assumes a seated position with forelegs substantially vertical. While keeping the spine in the erect position, the user holds the exercise apparatus 20 by the pair of handles 24 and 26 with the palms up. The user places the base 32 against the abdomen. The user then pulls the handles 24 and 26 towards the abdomen while tightening the abdominal muscles and crunching, causing the slide 30 to move to move through the immobilized yoke 22. This portion of the exercise is termed the concentric portion. When the abdominal muscles are in a fully tightened position and the user has forced the slide 30 as far as possible, the position is held. This portion of the exercise is termed the isometric portion. The user then slowly relaxes the abdominal muscles, allowing the slide 30 to gradually return to its starting position. This portion of the exercise is termed the eccentric portion.

The electronic coach 10 aids the user in accomplishing this multiple muscular phase exercise activity by determining that a first muscular phase, the concentric phase, should be performed, and providing a user perceptible output that prompts and instructs the user how to properly perform this phase. The electronic coach 10 then determines that a second muscular phase, the isometric phase, should be performed and provides a second user perceptible output that is different than the first, that prompts and instructs the user how to properly perform this phase. The electronic coach 10 may then determine that a third muscular phase, the eccentric phase, should be performed and will then provide a third user perceptible output that is different than the first and second that prompts and instructs the user how to properly perform this phase. The electronic coach 10 instructs the user through both visual and audio outputs as to the proper timing and method of performing each phase of the exercise activity.

Figure 2:
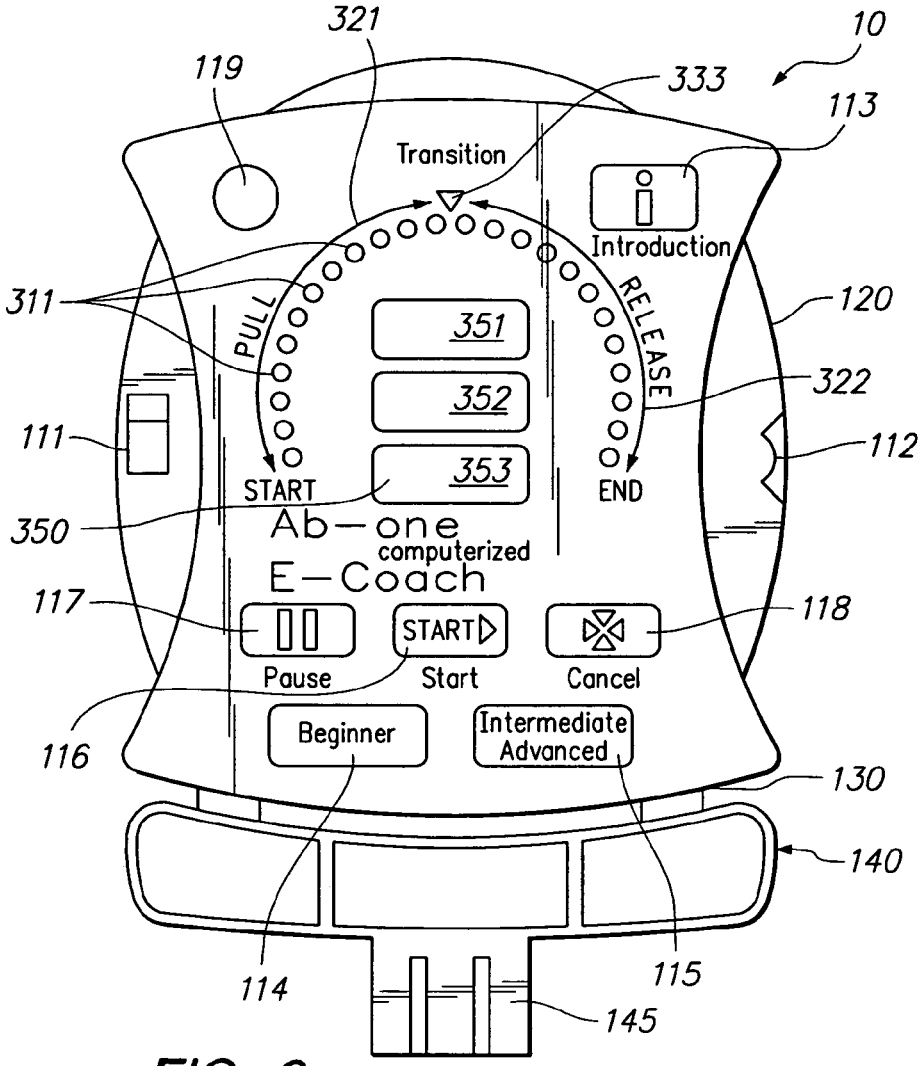
FIG. 2 is a plane view of an embodiment of an electronic coach device in accordance with the present invention.

FIG. 2 illustrates an electronic coach device 10 in more detail. The electronic coach device 10 includes a power switch 111, a volume control 112, and at least one button. The at least one button may be of a type commonly known in the art, and may include buttons corresponding to an introduction 113, various exercise levels and routines 114 and 115, as well as a start 116, a pause 117, and a cancel 118 button.

The electronic coach device 10 provides audio and visual outputs that guide the user of the exercise apparatus through the exercise. Speaker 119 may be located in the upper left corner of the electronic coach 10 and is of a type well known in the art. The speaker 119 outputs verbal commands and sounds at the appropriate times to instruct the user through the multiple phases of the exercise.

A plurality of lights 311 are arranged such that they form a graphical representation to the user of the proper timing for each exercise in the routine. In one embodiment of the present invention, the lights 311 are arranged in an arc 320 including a first segment 321 and a second segment 322 separated by an apex location 333. The lights in the first segment 321 of the arc may represent the concentric portion of the exercise, a single light in the apex location 323 may represent the isometric portion of the exercise, and lights in the second segment 322 of the arc represent the eccentric portion of the exercise. Additionally, the concentric lights in the first segment 321 may be of one color, the isometric light at the apex location 323 of another color, and the eccentric lights in the second segment 322 of a third color. In a preferred embodiment of the present invention, the lights in the first segment 321 will light in a consecutive cascading sequence to illustrate the concentric portion. These lights will then turn off when the concentric phase is complete, and then the single light at the apex location 323 illustrating the isometric portion is lit. This light will turn off when the isometric phase is complete, and the lights in the second segment 322 representing the eccentric portion are lit in a consecutive cascading sequence.

The display screen 350 is a conventional liquid crystal display (LCD). The display screen 350 is partitioned into three sections 351, 352, and 353 respectively, that display to the user the number of repetitions performed, the number of sets performed, and the amount of time that has elapsed during the exercise routine, respectively. The display is made using conventional numeric characters.

Although the lights 311 and display screen 350 are respectively shown to implement LEDs and an LCD display, various alternatives may be provided. For example, an LCD display may be used to provide the visual features of both the lights 311 and the display screen 350. Alternatively, LEDs, LCDs, or any other display type may be used for all or part of the visual features of the electronic coach 10.

The electronic coach 10 functions as follows. When the power switch 111 is turned to an "On" position, the user will be greeted by the Welcome track and instructed to press the "Start" button 116. When the "Start" button 116 is pressed, the electronic coach 10 may give the user the option of either pressing the "Introduction" button 113 or starting an exercise routine. If the "Introduction" button 113 is pressed, the electronic coach 10 will instruct the user on how to correctly perform the exercise, as well as how to use the electronic coach 10 and read the visual output device 504 by playing the Introduction track.

After the introduction is given, or if the user decides to skip the introduction, the user is instructed to select an exercise routine. Such routines may include a "Beginner" or an "Intermediate-Advanced" routine. When the user selects either of these routines 114 and 115 respectively, the electronic coach 10 will instruct the user when to pull the handles 24 and 26 (for the concentric phase of the abdominal exercise), when to hold the muscles in a contracted position (the isometric phase), and when to release them. It also visually and audibly guides the user to perform each phase of the exercise for the appropriate amount of time, the appropriate number of repetitions, and the appropriate number of sets of repetitions.

Figure 5:
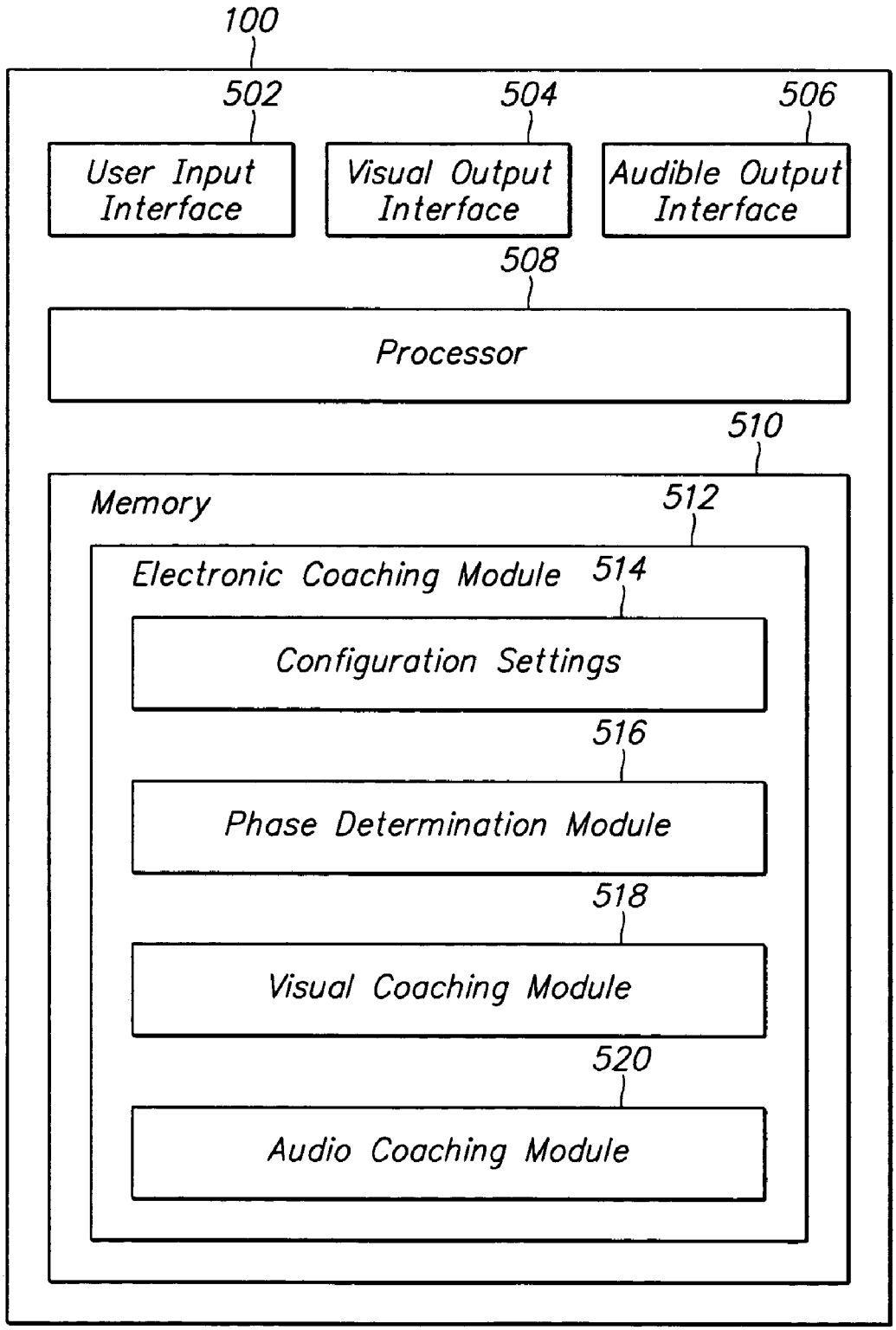
FIG. 5 is a block diagram illustrating an embodiment of an electronic coach device in accordance with the present invention.

The block diagram of FIG. 5 illustrates an embodiment of an electronic coach 100 to include a user input interface 502, visual output interface 504, audible output interface 506, processor 508, and memory 510. The user input interface 502 receives user input through the above described buttons. The visual output interface 504 connects to and provides appropriate signals to the visual displays provided by the electronic coach 100, such as provided via the above described lights and LCD display. The audible output interface 506 connects to and provides appropriate signals to the audio output device (e.g. speakers) of the electronic coach 10.

The electronic coach 10 is arranged to respond to user input and provide appropriate output according to instructions that are stored in a memory 510 and executed by a processor 508. More specifically, the memory 510 includes an electronic coaching module 512 for providing these instructions and the corresponding functionality. The electronic coaching module 512 is preferably provided as software, but can alternatively be provided as hardware or firmware, or any combination of software, hardware and firmware.

The electronic coaching module 512 further includes a configuration settings module 514, a phase determination module 516, a visual coaching module 518, and an audio coaching module 520. The configuration settings module 514 communicates with the user input interface 502. It determines and retains the type of user input received ("Introduction", "Beginner", "Intermediate Advanced" etc.), and also provides corresponding basic functionality such as presentation of the introduction sequence where such is requested.

The phase determination module 516 determines whether the exercise activity should be performed according to one or more particular muscular phases (e.g., concentric, isometric and eccentric). It also communicates such determined phases to the visual coaching module 518 and the audio coaching module 520, which causes them to provide particular visual and audio outputs that are intended to instruct and prompt the user to operate the exercise apparatus correctly, according to the determined muscular phases. In one embodiment, the phase determination module 516 implements a timer to determine the commencement and conclusion of the muscular phases. The phase determination module 516 further communicates with the configuration settings module 514 to determine the operational mode, and includes instructions that determine the number of sets and repetitions within each set are to be performed, with appropriate determination of muscular phases during the course of an exercise activity.

The visual coaching module 518 produces signals that control the display elements of the electronic coach 10 through the visual output interface 504. In one embodiment, the visual coaching module 518 includes software based instructions that cause the signals to be produced for an appropriate amount of time (e.g., 2-8 seconds) after initial indication that a particular muscular phase has commenced. Conventional signals for driving the LED and LCD displays may be used to accommodate the driving of the displays.

The audio coaching module 520 similarly produces signals that control the audio output elements of the electronic coach 10 through the audible output interface 506. Again, the audio coaching module 520 may include software that causes an audio output to commence and proceed for an appropriate amount of time after indication that a particular muscular phase has commenced. The audio output signals may be stored as .wav files or files in other conventional formats.

Figure 6:
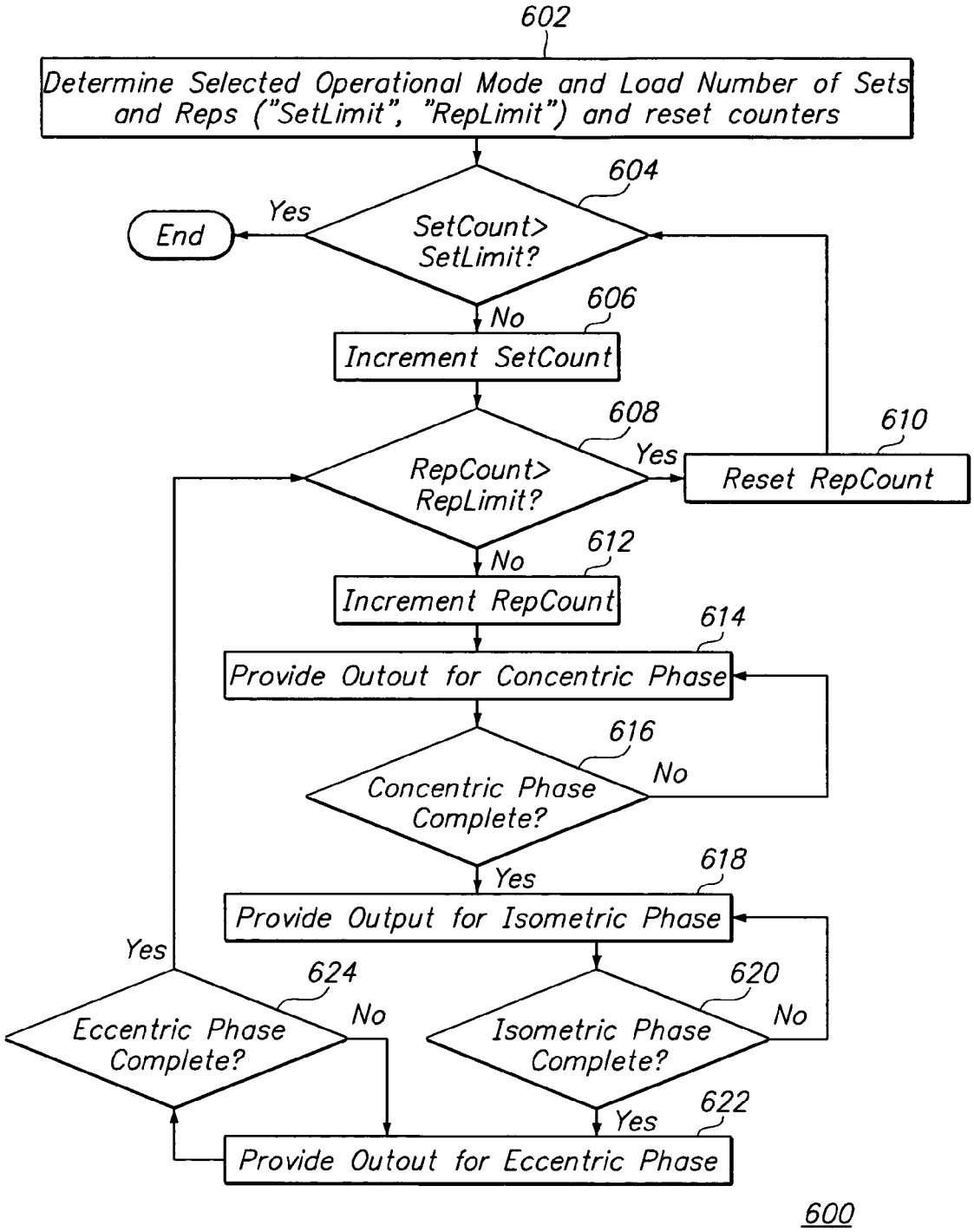
FIG. 6 is a flow diagram illustrating an embodiment of an electronic coaching functionality in accordance with the present invention.

The flow diagram of FIG. 6 illustrates a process 600 for coaching a user of an exercise apparatus, such as performed according to the instructions in the electronic coaching module (512). As described, the user selects an operational mode such as "Beginner" or "Intermediate Advanced." Other selections may also be made, includes a three options selection offering "Beginner", "Intermediate", and "Advanced", or various other numbers and types of options.

In step 602, the operational mode is determined and then the appropriate number of sets and repetitions are loaded so that the coaching can sequence through the appropriate number of sets and repetitions (typically the same number each set, but alternatively a varying number) to be performed. The number of sets and repetitions are retained in association with variable names such as "SetLimit" and "Replimit." These can of course be arrays, such as where the number of repetitions varies. During the course of the instructions, counters determine the number of sets and repetitions that have been performed (e.g., "SetCount" and "RepCount"). These counters are reset to zero at the commencement of the exercise program. Upon determination 604 that the number of sets has not been completed (i.e., SetCount is not greater than SetLimit), the count of the number of sets is incremented 604. Since the number of reps is also initialized, it is determined 608 that the count is under the limit, the rep count is incremented 610, and then output for the first phase of the exercise is provided 614. Preferably, the current set and rep numbers are caused to be displayed by the electronic coach in the previously introduced display locations.

In one embodiment, the first phase of exercise is the concentric phase. Accordingly, visual and audio output signals appropriate for the concentric phase are provided. More specifically, as previously described this display may be the sequential lighting of LEDs along a first arc segment visually corresponding to the concentric phase of the exercise. Similarly, appropriate audio commands are played during this phase, such as "Pull slowly, move your shoulders forward while crunching."

The concentric phase output is provided 614 until it is determined 616 that the concentric phase has been completed, which is preferably 2-8 seconds after commencement of the phase.

Upon completion of the concentric phase, output for the isometric phase is commenced 618. Again, visual and audio output signals appropriate for the isometric phase are provided, such as lighting of an LED at the apex of the arc, and instructions such as "Hold it, and tighten those abs!" This output is provided 618 until it is determined 620 that the isometric phase is completed, which is preferably 2-8 seconds after commencement of the isometric phase.

The eccentric phase then commences and appropriate output for that phase is provided 622, until it is determined 624 that it too has been completed, again preferably 2-8 seconds after commencement. Here, lighting of the second arc segment and audio instructions such as "Now, release slowly and tighten those abs!" are caused to be output to the user through the electronic coaching device.

The sequence of providing concentric 614, isometric 616 and eccentric 618 visual and audio outputs continues until it is determined 608 that the number of reps has been completed (RepCount>RepLimit) and it is determined 604 that the last set has been completed (SetCount>SetLimit), upon which the phase based instructions terminate. Output appropriate for the conclusion of the exercise session, such as encouraging and congratulatory words, and other helpful comments, such as daily diet and health advice, can then be provided to the user if desired.

Figure 7:
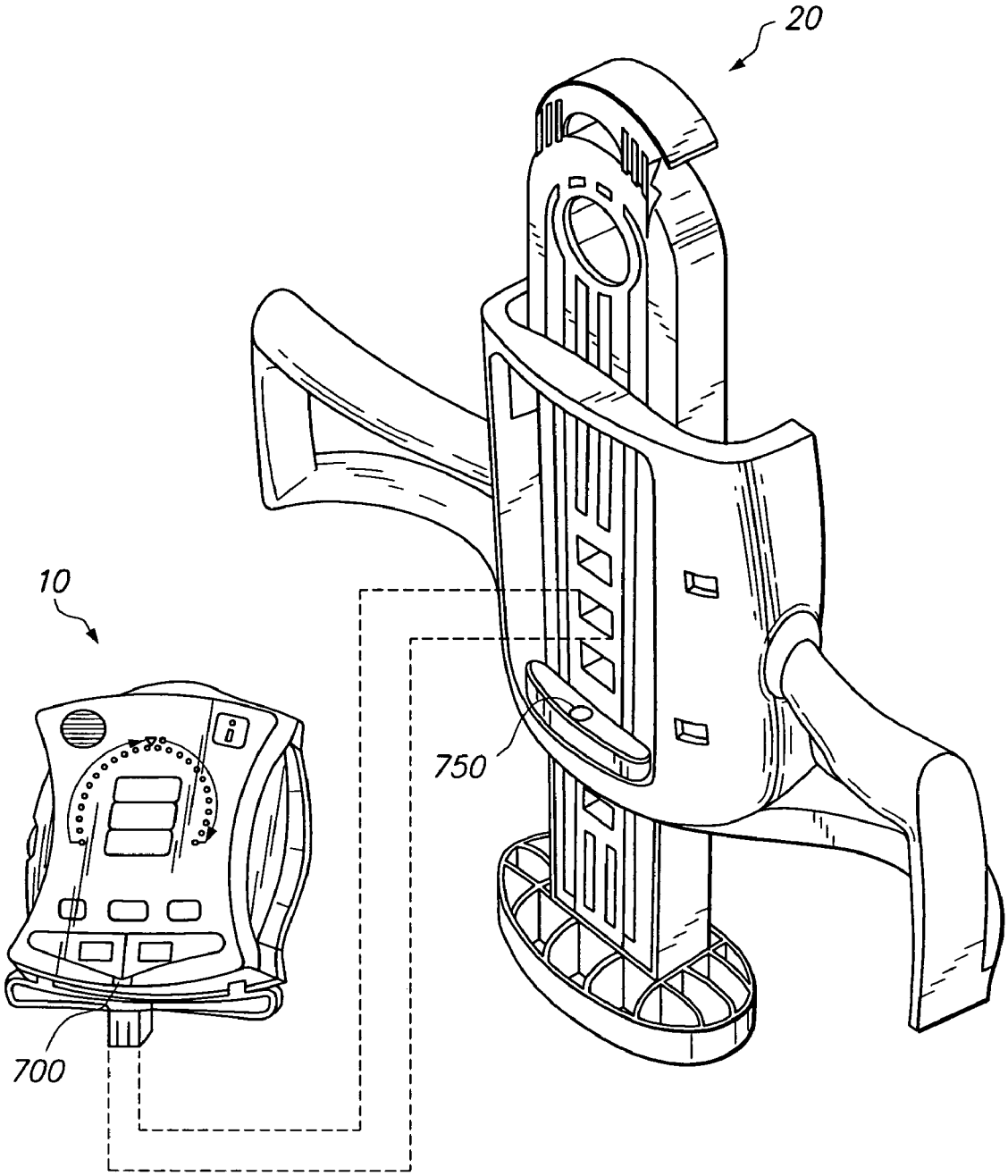
FIG. 7 is a perspective view of another embodiment of an electronic coach device and exercise device with a magnetic proximity sensor system.

In an alternative embodiment of the present invention, shown in FIG. 7, the electronic coach 10 may include a magnetic proximity sensor 700 that senses a magnet 750 mounted on the exercise device 20. In this embodiment, the electronic coach 10 may determine when the routine has begun, as well as the length of time the user takes to accomplish each phase. If the length of time that it takes the user to accomplish each phase does not fall within allowable or preferred limits, the electronic coach 10 may inform the user that the particular phase(s) of the exercise should be sped up or slowed down. Such information may be provided during the course of exercise or by reporting the results after completion. Additionally, the audio and/or visual information may adjust based upon the detection of the amount of time against the preferred range. Thus, for example, audio may instruct the user to speed up or slow down during one or more phases, and video may similarly prompt the same, such as by supplementing the existing visual display or altering the colors of the existing visual display.

It will be apparent to those skilled in the art that various modifications and variations can be made in the construction, configuration, and/or operation of the present invention without departing from the scope or spirit of the invention.

The invention claimed is:

1. For use with an exercise apparatus that a user operates to perform an exercise activity having multiple muscular phases, a method for coaching the user with an electronic coaching device, the method comprising: determining that the exercise activity should be performed according to a first muscular phase; providing a first user perceptible output from the coaching device to prompt the user to operate the exercise apparatus according to the first muscular phase; determining that the exercise activity should be performed according to a second muscular phase that differs from the first muscular phase; and providing a second user perceptible output from the coaching device to prompt the user to operate the exercise apparatus according to the second muscular phase, wherein the second user perceptible output differs from the first user perceptible output, wherein the muscular phases are selected from the group consisting of an isokenetic, an osometric, a concentric, and an eccentric muscular phase.

2. The method of claim 1, further comprising: determining that the exercise activity should be performed according to a third muscular phase that differs from the first and second muscular phases; and providing a third user perceptible output from the coaching device to prompt the user to operate the exercise apparatus according to the third muscular phase, wherein the third user perceptible output differs from the first and second user perceptible outputs.

3. The method of claim 2, wherein the first, second and third user perceptible outputs comprise a visual display.

4. The method of claim 3, wherein the first muscular phase is a concentric phase, the second muscular phase is an eccentric phase, and the third muscular phase is an isometric phase.

5. The method of claim 4, wherein the visual display includes an arc including a first segment and a second segment separated by an apex location, such that the first segment visually prompts the user to operate the exercise apparatus according to the concentric phase, the second segment visually prompts the user to operate the exercise apparatus according to the eccentric phase, and the apex location visually prompts the user to operate the exercise apparatus according to the isometric phase.

6. The method of claim 5, wherein the visual display is provided by an array of LEDs arranged to provide the arc.

7. The method of claim 4, wherein the concentric, eccentric, and isometric phases each last for 2 to 8 seconds.

8. The method of claim 2, wherein the first, second and third user perceptible outputs comprise an audio output.

9. The method of claim 8, wherein the first muscular phase is a concentric phase, the second muscular phase is an eccentric phase, and the third muscular phase is an isometric phase, and wherein the audio output includes a first verbal command that prompts the user to operate the exercise apparatus according to the concentric phase, a second verbal command that prompts the user to operate the exercise apparatus according to the eccentric phase, and a third verbal command that prompts the user to operate the exercise apparatus according to the isometric phase.

10. The method of claim 4, wherein the first, second and third user perceptible outputs further comprise an audio output, the audio output further including a first verbal command that is synchronized with a first visual display to prompt the user to operate the exercise apparatus according to the concentric phase, a second verbal command that is synchronized with a second visual display to prompt the user to operate the exercise apparatus according to the eccentric phase, and a third verbal command that is synchronized with a third visual display to prompt the user to operate the exercise apparatus according to the isometric phase.

11. The method of claim 1, wherein the first and second user perceptible outputs comprise a visual display.

12. The method of claim 11. wherein the first muscular phase is a concentric phase and the second muscular phase is an eccentric phase.

13. The method of claim 12, wherein the visual display includes an arc including a first segment and a second segment, such that the first segment visually prompts the user to operate the exercise apparatus according to the concentric phase, the second segment visually prompts the user to operate the exercise apparatus according to the eccentric phase.

14. The method of claim 13, wherein the visual display is provided by an array of LEDs arranged to provide the arc.

15. The method of claim 11, wherein the concentric and eccentric phase each last for 2 to 8 seconds.

16. The method of claim 2, wherein the exercise activity is an abdominal exercise.

17. The method of claim 16, wherein the first and second user perceptible outputs comprise an audio output, the first muscular phase is a concentric phase and the second muscular phase is an eccentric phase, and the audio output includes a first verbal command that prompts the user to operate the exercise apparatus according to the concentric phase and a second verbal command that prompts the user to operate the exercise apparatus according to the eccentric phase.

18. The method of claim 12, wherein the first and second user perceptible outputs further comprise an audio output, the audio output further including a first verbal command that is synchronized with a first visual display to prompt the user to operate the exercise apparatus according to the concentric phase and a second verbal command that is synchronized with a second visual display to prompt the user to operate the exercise apparatus according to the eccentric phase.

* * * * *